US010468005B2

(12) United States Patent
Toyama et al.

(10) Patent No.: US 10,468,005 B2
(45) Date of Patent: Nov. 5, 2019

(54) DETECTION DEVICE FOR DETECTING OPERATION POSITION

(71) Applicant: CASIO COMPUTER CO., LTD., Shibuya-ku, Tokyo (JP)

(72) Inventors: Chihiro Toyama, Hachioji (JP); Kazutaka Kasuga, Fussa (JP); Ryutaro Hayashi, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/031,497

(22) Filed: Jul. 10, 2018

(65) Prior Publication Data

US 2019/0019485 A1 Jan. 17, 2019

(30) Foreign Application Priority Data

Jul. 13, 2017 (JP) ..... 2017-136895

(51) Int. Cl.

| | |
|---|---|
| ***G10H 1/44*** | (2006.01) |
| ***G10H 1/00*** | (2006.01) |
| ***G10H 1/055*** | (2006.01) |
| ***G10H 1/46*** | (2006.01) |

(52) U.S. Cl.

CPC ..... *G10H 1/44* (2013.01); *G10H 1/0008* (2013.01); *G10H 1/0551* (2013.01); *G10H 1/46* (2013.01); *G10H 2220/275* (2013.01); *G10H 2220/361* (2013.01); *G10H 2230/205* (2013.01); *G10H 2230/221* (2013.01)

(58) Field of Classification Search

CPC ..... G10H 1/44
USPC ..... 84/615
See application file for complete search history.

(56) References Cited

U.S. PATENT DOCUMENTS 2,138,500 A * 11/1938 Miessner ..... G10H 3/16 84/283
3,429,976 A * 2/1969 Tomcik ..... G10H 3/143 84/385 R
4,901,618 A * 2/1990 Blum, Jr. ..... G09B 15/06 84/453

(Continued)

FOREIGN PATENT DOCUMENTS

EP 2527958 A1 11/2012
JP 2016177026 A 10/2016

(Continued)

OTHER PUBLICATIONS

Extended European Search Report (EESR) dated Oct. 19, 2018 issued in counterpart European Application No. 18183081.1.

*Primary Examiner* — David S Warren
(74) *Attorney, Agent, or Firm* — Holtz, Holtz & Vilek PC

(57) ABSTRACT

A detection device including n number of sensors arrayed in a direction, in which n is an integer of 3 or more and from which (n−1) pairs of adjacent sensors are formed, and a processor which determines one specified position in the direction based on output values of the n number of sensors, in which the processor calculates (n−1) sets of difference values each of which is a difference between two output values corresponding to each of the (n−1) pairs of sensors, and determines the one specified position based on the (n−1) sets of difference values and correlation positions corresponding to the (n−1) sets of difference values and indicating positions correlated with array positions of each pair of sensors.

16 Claims, 9 Drawing Sheets

(56) References Cited

U.S. PATENT DOCUMENTS 4,951,545 A * 8/1990 Yoshida ..... G10H 1/342 84/646
6,846,980 B2 * 1/2005 Okulov ..... G10H 1/342 84/613
6,967,277 B2 * 11/2005 Querfurth ..... G10H 1/0066 704/265
7,049,503 B2 * 5/2006 Onozawa ..... G10H 1/055 84/723
8,321,174 B1 11/2012 Moyal et al.
9,646,591 B1 * 5/2017 Young ..... G10H 1/342
9,653,057 B2 5/2017 Harada et al.
9,761,210 B2 * 9/2017 McPherson ..... G06F 3/03547
10,037,104 B2 7/2018 Miyahara et al.
2008/0236374 A1 * 10/2008 Kramer ..... G10H 1/0016 84/733
2008/0238448 A1 * 10/2008 Moore ..... G10H 3/10 324/686
2009/0020000 A1 * 1/2009 Onozawa ..... G10D 7/00 84/723
2009/0216483 A1 * 8/2009 Young ..... G10H 1/46 702/138
2009/0314157 A1 * 12/2009 Sullivan ..... G10H 1/342 84/646
2010/0175541 A1 * 7/2010 Masuda ..... G10H 5/007 84/622
2012/0006181 A1 * 1/2012 Harada ..... G10H 1/0008 84/600
2014/0146008 A1 5/2014 Miyahara et al.
2016/0071430 A1 * 3/2016 Claps ..... G09B 15/023 84/485 R
2016/0210950 A1 * 7/2016 McPherson ..... G06F 3/03547
2016/0275929 A1 * 9/2016 Harada ..... G10H 1/46
2016/0275930 A1 * 9/2016 Harada ..... G10H 1/46
2017/0178611 A1 * 6/2017 Eventoff ..... G10H 3/00
2017/0228099 A1 8/2017 Miyahara et al.
2018/0075831 A1 * 3/2018 Toyama ..... G10H 1/0551
2018/0082664 A1 * 3/2018 Sasaki ..... G10B 3/22
2018/0090120 A1 * 3/2018 Kasuga ..... G10H 1/043
2018/0102120 A1 * 4/2018 Eventoff ..... G10H 3/00
2018/0268791 A1 * 9/2018 Okuda ..... G10H 1/0008
2018/0366095 A1 * 12/2018 Hashimoto ..... G01H 11/08
2019/0005931 A1 * 1/2019 Kasuga ..... G10H 1/0551
2019/0005932 A1 * 1/2019 Tabata ..... G10H 1/0551
2019/0019485 A1 * 1/2019 Toyama ..... G10H 1/0008

FOREIGN PATENT DOCUMENTS

JP 2017015809 A 1/2017
JP 2017058502 A 3/2017

* cited by examiner

| SENSOR POSITION | PS1 | PS2 | PS3 | PS4 | PS5 | PS6 | PS7 | PS8 | PS9 | PS10 | Total1 | Total2 | PS(1-10) |
|---|---|---|---|---|---|---|---|---|---|---|---|---|---|
| SENSOR OUTPUT VALUE | 22 | 110 | 135 | 142 | 143 | 143 | 143 | 129 | 27 | 9 | 5154 | 1003 | 5.10 |

| SENSOR POSITION | PS1 | PS2 | PS3 | PS4 | PS5 | PS6 | PS7 | PS8 | PS9 | PS10 | Total1 | Total2 | PS(1-10) |
|---|---|---|---|---|---|---|---|---|---|---|---|---|---|
| SENSOR OUTPUT VALUE | 20 | 108 | 133 | 141 | 142 | 142 | 142 | 140 | 120 | 20 | 6155 | 1108 | 5.55 |

FIG. 6A

< LIP POSITION BASED ON AMOUNT OF CHANGE BETWEEN ADJACENT SENSORS (NORMAL LIP) >

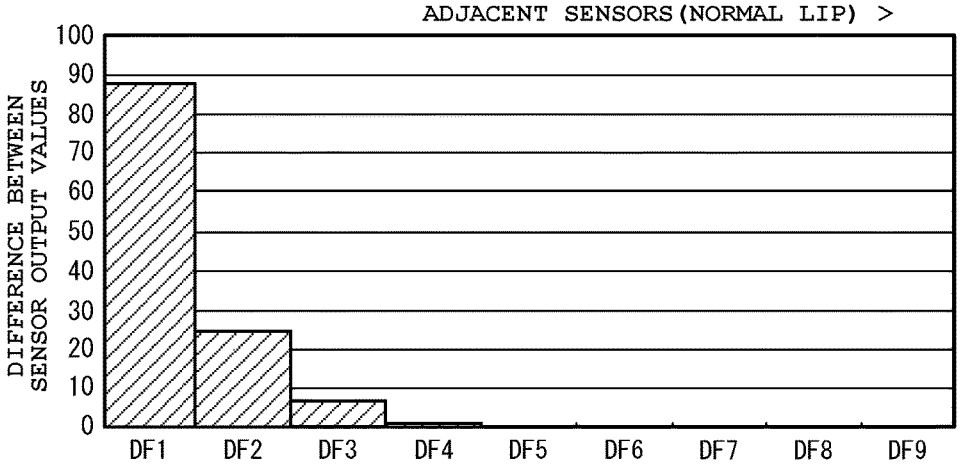

| CORRELATION POSITION BETWEEN SENSORS | DF1 | DF2 | DF3 | DF4 | DF5 | DF6 | DF7 | DF8 | DF9 | Total1 | Total2 | PS(DF) |
|---|---|---|---|---|---|---|---|---|---|---|---|---|
| DIFFERENCE BETWEEN SENSOR OUTPUT VALUES | 88 | 25 | 7 | 1 | 0 | 0 | 0 | 0 | 0 | 163 | 121 | 1.35 |

FIG. 6B

< LIP POSITION BASED ON AMOUNT OF CHANGE BETWEEN ADJACENT SENSORS (THICK LIP) >

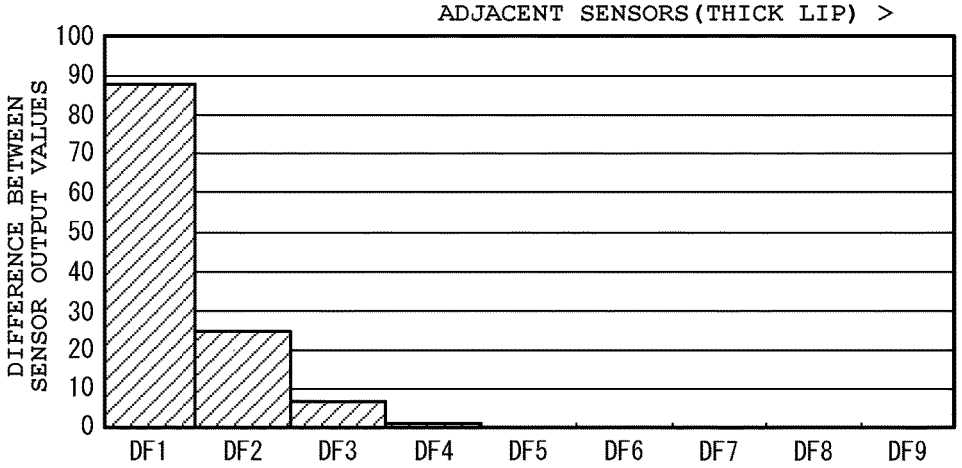

| CORRELATION POSITION BETWEEN SENSORS | DF1 | DF2 | DF3 | DF4 | DF5 | DF6 | DF7 | DF8 | DF9 | Total1 | Total2 | PS(DF) |
|---|---|---|---|---|---|---|---|---|---|---|---|---|
| DIFFERENCE BETWEEN SENSOR OUTPUT VALUES | 89 | 25 | 8 | 1 | 0 | 0 | 0 | 0 | 0 | 167 | 123 | 1.35 |

DETECTION DEVICE FOR DETECTING OPERATION POSITION

CROSS-REFERENCE TO RELATED APPLICATION

This application is based upon and claims the benefit of priority from the prior Japanese Patent Application No. 2017-136895, filed Jul. 13, 2017, the entire contents of which are incorporated herein by reference.

BACKGROUND OF THE INVENTION

1. Field of the Invention

The present invention relates to a detection device for detecting an operation position, an electronic musical instrument, and an operation position detection method.

2. Description of the Related Art

Conventionally, electronic wind instruments whose shape and musical performance method are modeled after those of acoustic wind instruments such as saxophone and clarinet have been known. In musical performance of these electronic wind instruments, by operating a switch (pitch key) provided to a key position similar to that of acoustic wind instruments, the tone of a musical sound is specified. Also, the sound volume is controlled by the pressure of a breath (breath pressure) blown into a mouthpiece, and the timbre is controlled by the position of the lip, the contact status of the tongue, the biting pressure, and the like when the mouthpiece is held in the mouth.

For the above-described control, the mouthpiece of a conventional electronic wind instrument is provided with various sensors for detecting a blown breath pressure, the position of a lip, the contact status of a tongue, a biting pressure, and the like at the time of musical performance. For example. Japanese Patent Application Laid-Open (Kokai) Publication No. 2017-058502 discloses a technique in which a plurality of capacitive touch sensors are arranged on the reed section of the mouthpiece of an electronic wind instrument so as to detect the lip of an instrument player, the contact status of the tongue, and the contact position based on detection values and arrangement positions of the plurality of sensors.

SUMMARY OF THE INVENTION

In accordance with one aspect of the present invention, there is provided a detection device comprising: n number of sensors arrayed in a direction, in which n is an integer of 3 or more and from which (n−1) pairs of adjacent sensors are formed; and a processor which determines one specified position in the direction based on output values of the n number of sensors, wherein the processor calculates (n−1) sets of difference values each of which is a difference between two output values corresponding to each of the (n−1) pairs of sensors, and determines the one specified position based on the (n−1) sets of difference values and correlation positions corresponding to the (n−1) sets of difference values and indicating positions correlated with array positions of each pair of sensors.

In accordance with another aspect of the present invention, there is provided an electronic musical instrument comprising: a sound source which generates a musical sound; n number of sensors arrayed in a direction, in which n is an integer of 3 or more and from which (n−1) pairs of adjacent sensors are formed; and a processor which determines one specified position in the direction based on output values of the n number of sensors, wherein the processor calculates (n−1) sets of difference values each of which is a difference between two output values corresponding to each of the (n−1) pairs of sensors, determines the one specified position based on the (n−1) sets of difference values and correlation positions corresponding to the (n−1) sets of difference values and indicating positions correlated with array positions of each pair of sensors, and controls the musical sound that is generated by the sound source, based on the one specified position.

In accordance with another aspect of the present invention, there is provided a detection method for an electronic device, comprising: acquiring output values from n number of sensors arrayed in a direction, in which n is an integer of 3 or more and from which (n−1) pairs of adjacent sensors are formed; calculating (n−1) sets of difference values each of which is a difference between two output values corresponding to each of the (n−1) pairs of sensors; and determining the one specified position based on the (n−1) sets of difference values and correlation positions corresponding to the (n−1) sets of difference values and indicating positions correlated with array positions of each pair of sensors.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The present application will be more clearly understood by taking the following detailed description into consideration together with the drawings described below:

FIG. 1A and FIG. 1B each show the entire structure of an embodiment of an electronic musical instrument to which a detection device according to the present invention has been applied, of which FIG. 1A is a side view of the electronic musical instrument and FIG. 1B is a front view of the electronic musical instrument;

FIG. 3A and FIG. 3B show an example of a mouthpiece to be applied to the electronic musical instrument according to the embodiment, of which FIG. 3A is a sectional view of the mouthpiece and FIG. 3B is a bottom view of the reed section side of the mouthpiece;

FIG. 5A and FIG. 5B each show an example (comparative example) of output characteristics of a lip detection section with the mouthpiece being held in the mouth of the instrument player and an example of calculation of lip positions, of which FIG. 5A is a diagram of an example in which the instrument player has a lip with a normal thickness and FIG. 5B is a diagram of an example in which the instrument player has a lip thicker than normal;

FIG. 6A and FIG. 6B each show an example (present embodiment) of change characteristics of detection information regarding the lip detection section with the mouthpiece being held in the mouth of the instrument player and an example of calculation of a lip position, of which FIG. 6A is a diagram of an example in which the instrument player has a lip with a normal thickness and FIG. 5B is a diagram of an example in which the instrument player has a lip thicker than normal;

DETAILED DESCRIPTION OF THE PREFERRED EMBODIMENTS

Embodiments of a detection device, an electronic musical instrument, and a detection method according to the present invention will hereinafter be described with reference to the drawings. Here, the present invention is described using an example of an electronic musical instrument in which a detection device for detecting an operation position has been applied and an example of a control method for the electronic musical instrument in which the operation position detection method has been applied.

<Electronic Musical Instrument>

Figure 1A:
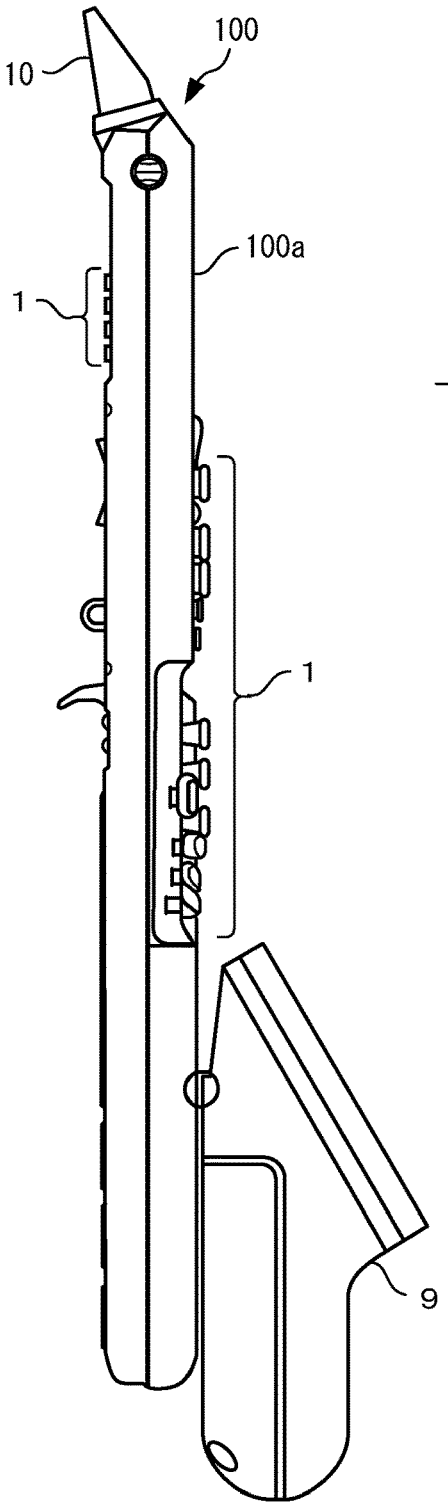
Figure 1B:
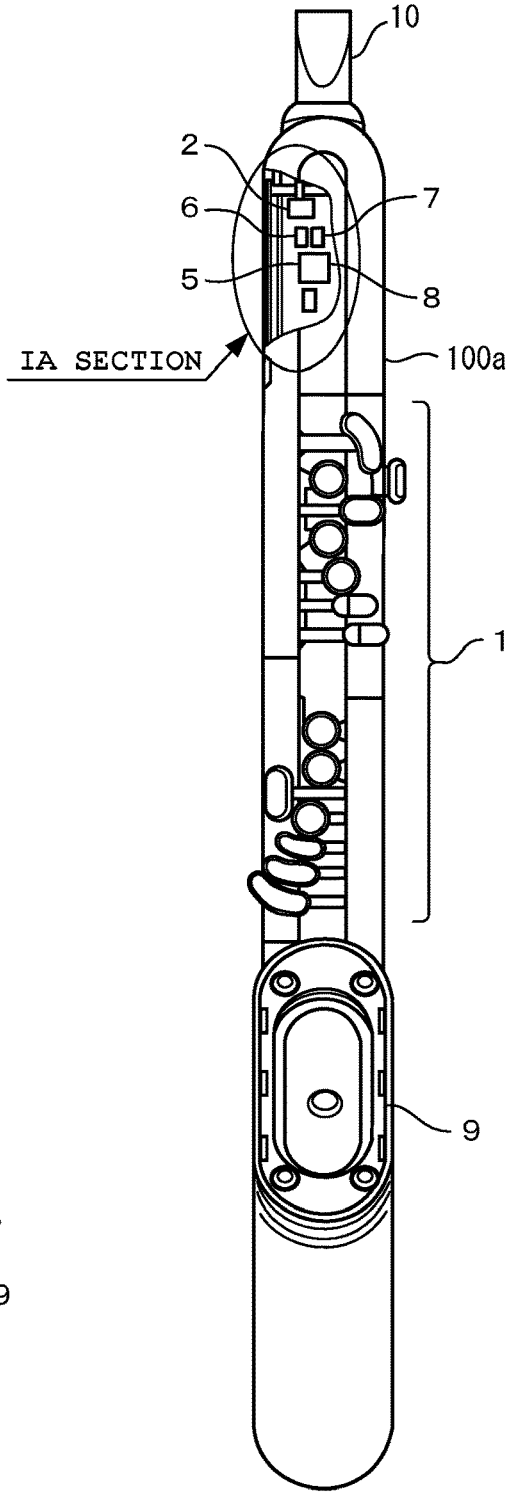

FIG. 1A and FIG. 1B each show an external view of the entire structure of an embodiment of an electronic musical instrument in which a detection device according to the present invention has been applied, of which FIG. 1A is a side view of the electronic musical instrument according to the present embodiment and FIG. 1B is a front view of the electronic musical instrument. In the drawings, an IA section shows a partial transparent portion of the electronic musical instrument 100.

The electronic musical instrument 100 in which the detection device according to the present invention has been applied has an outer appearance similar to the shape of a saxophone that is an acoustic wind instrument, as shown in FIG. 1A and FIG. 1B. At one end side (upper end side in the drawings) of a tube body section 100*a* having a tubular housing, a mouthpiece 10 to be held in the mouth of an instrument player is attached. At the other end side (lower end side in the drawings), a sound system 9 with a loudspeaker which outputs a musical sound is provided.

Also, on a side surface of the tube body section 100*a*, operators 1 are provided which include musical performance keys which determine pitches and setting keys for setting functions of changing the pitches in accordance with the key of a musical piece, with the instrument player (user) operating with fingers. Also, as shown in the IA section of FIG. 1B, a breath pressure detection section 2, a CPU (Central Processing Unit) 5 as control means, a ROM (Read Only Memory) 6, a RAM (Random Access Memory) 7, and a sound source 8 are provided on a board provided inside the tube body section 100*a*.

Figure 2:
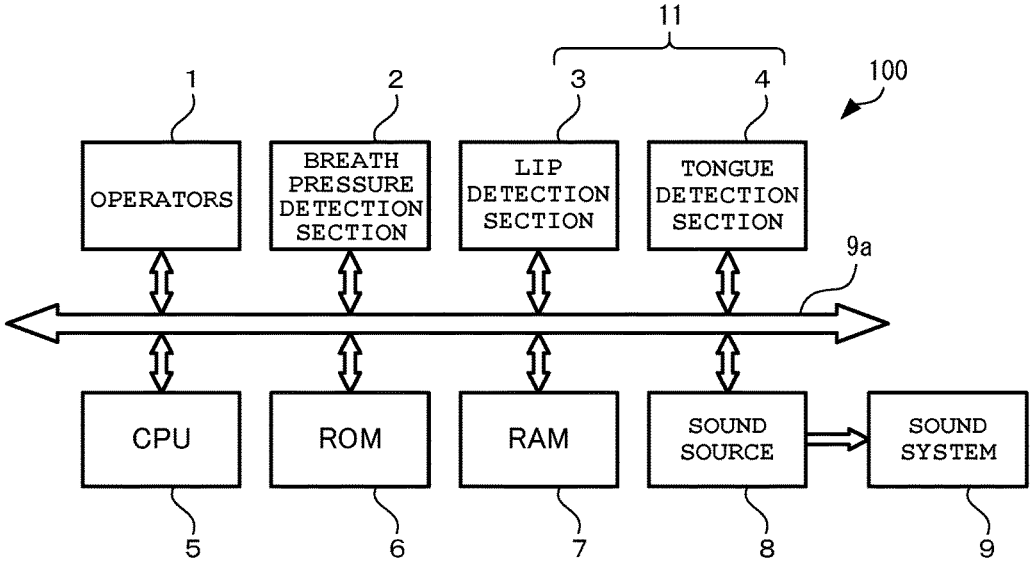
FIG. 2 is a block diagram showing an example of a functional structure of the electronic musical instrument according to the embodiment.

FIG. 2 is a block diagram showing an example of a functional structure of the electronic musical instrument according to the present embodiment.

The electronic musical instrument 100 according to the present embodiment mainly has the operators 1, the breath pressure detection section 2, a lip detection section 3, and a tongue detection section 4, the CPU 5, the ROM 6, the RAM 7, the sound source 8, and the sound system 9, as shown in FIG. 2. Of these, the sections other than the sound system 9 are mutually connected via a bus 9*a*. Here, the lip detection section 3 and the tongue detection section 4 are provided to a reed section 11 of the mouthpiece 10 described further below. Note that the functional structure shown in FIG. 2 is merely an example for achieving the electronic musical instrument according to the present invention, and the present invention is not limited to this structure. Also, in the functional structure of the electronic musical instrument shown in FIG. 2, at least the lip detection section 3 and the CPU 5 form a detection device according to the present invention.

The operators 1 accept the instrument player's key operation performed on any of various keys such as the musical performance keys and the setting keys described above so as to output that operation information to the CPU 5. Here, the setting keys provided to the operators 1 have a function of changing pitch in accordance with the key of a musical piece, as well as a function of fine-tuning the pitch, a function of setting a timbre, and a function of selecting, in advance, a mode for fine-tuning in accordance with a contact state of a lip (lower lip) detected by the lip detection section 3 from among modes of the tone, sound volume, pitch of a musical sound.

The breath pressure detection section 2 detects the pressure of a breath (breath pressure) blown by the instrument player into the mouthpiece 10, and outputs that breath pressure information to the CPU 5. The lip detection section 3 has a capacitive touch sensor which detects a contact state of the lip of the instrument player, and outputs a capacitance in accordance with the contact position or contact range of the lip, the contact area, and the contact strength to the CPU 5 as lip detection information. The tongue detection section 4 has a capacitive touch sensor which detects a contact state of the tongue of the instrument player, and outputs the presence or absence of a contact of the tongue and a capacitance in accordance with its contact area to the CPU 5 as tongue detection information.

The CPU 5 functions as a control section which controls each section of the electronic musical instrument 100. The CPU 5 reads a predetermined program stored in the ROM 6, develops the program in the RAM 7, and executes various types of processing in cooperation with the developed program. For example, the CPU 5 instructs the sound source 8 to generate a musical sound based on breath pressure information inputted from the breath pressure detection section 2, lip detection information inputted from the lip detection section 3, and tongue detection information inputted from the tongue detection section 4.

Specifically, the CPU 5 sets the pitch of a musical sound based on pitch information serving as operation information inputted from any of the operators 1. Also, the CPU 5 sets the sound volume of the musical sound based on breath pressure information inputted from the breath pressure detection section 2, and finely tunes at least one of the timbre, the sound volume, and the pitch of the musical sound based on lip detection information inputted from the lip detection section 3. Also, based on tongue detection information inputted from the tongue detection section 4, the CPU 5 judges whether the tongue has come in contact, and sets the note-on/note-off of the musical sound.

The ROM 6 is a read-only semiconductor memory. In the ROM 6, various data and programs for controlling operations and processing in the electronic musical instrument 100 are stored. In particular, in the present embodiment, a program for achieving a lip position determination method to be applied to an electronic musical instrument control method described further below (corresponding to the operation position detection method according to the present invention) is stored. The RAM 7 is a volatile semiconductor memory, and has a work area for temporarily storing data and a program read from the ROM 6 or data generated during execution of the program, and detection information outputted from the operators 1, the breath pressure detection section 2, the lip detection section 3, and the tongue detection section 4.

The sound source 8 is a synthesizer. By following a musical sound generation instruction from the CPU 5 based on operation information from any of the operators 1, lip detection information from the lip detection section 3, and tongue detection information from the tongue detection section 4, the sound source 8 generates and outputs a musical sound signal to the sound system 9. The sound system 9 performs processing such as signal amplification on the musical sound signal inputted from the sound source 8, and outputs the processed musical sound signal from the incorporated loudspeaker as a musical sound.

(Mouthpiece)

Next, the structure of the mouthpiece to be applied to the electronic musical instrument according to the present embodiment is described.

Figure 3A:
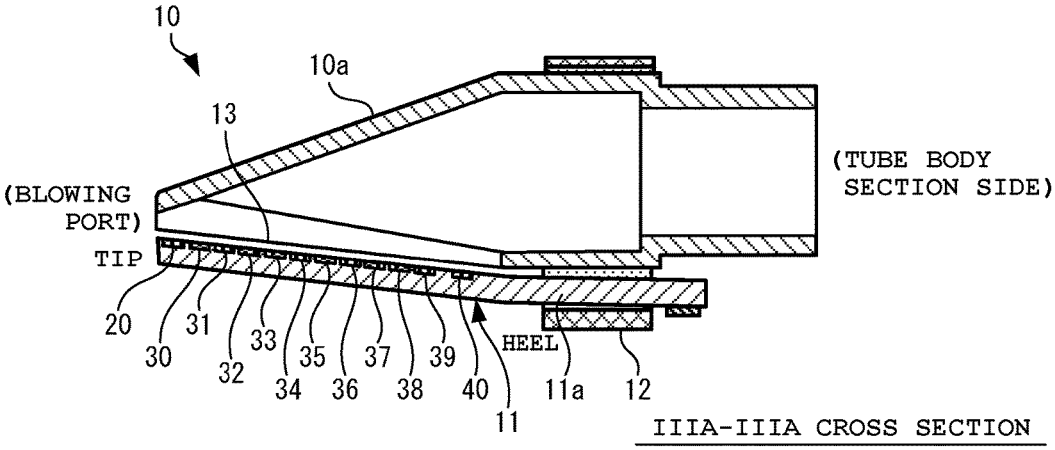
Figure 3B:
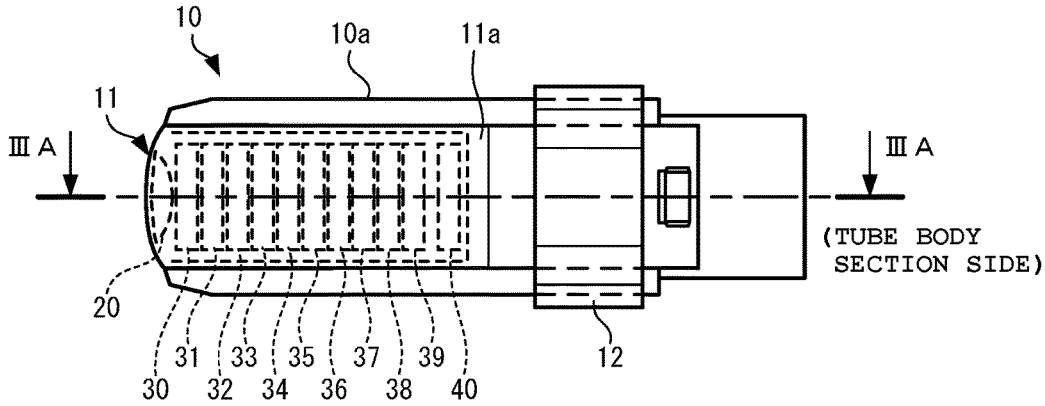

FIG. 3A and FIG. 3B show an example of the mouthpiece to be applied to the electronic musical instrument according to the present embodiment. Here, FIG. 3A is a sectional view of the mouthpiece (a sectional view along line IIIA-IIIA in FIG. 3B) and FIG. 3B is a bottom view of the reed section 11 side of the mouthpiece.

The mouthpiece 10 mainly has a mouthpiece main body 10*a*, a reed section 11, and a fixing piece 12, as shown in FIG. 3A and FIG. 3B. The mouthpiece 10 is structured such that the reed section 11 in a thin plate shape is assembled and fixed by the fixing piece 12 so as to have a slight gap as a blow port into which the instrument player blows a breath to an opening 13 of the mouthpiece main body 10*a*. That is, as with the reed of a general acoustic wind instrument, the reed section 11 is assembled at a position on the lower side of the mouthpiece main body 10*a* (the lower side of FIG. 3A), and has a base end section (hereinafter referred to as a "heel") fixed by the fixing piece 12 as a fixing end and a blowing side (hereinafter referred to as a "tip side") as a free end side.

The reed section 11 also has a reed board 11*a* made of a thin-plate-shaped insulating member and a plurality of sensors 20 and 30 to 40 arrayed from the tip side (one end side) toward the heel side (the other end side) in the longitudinal direction (lateral direction in the drawings) of the reed board 11*a*, as shown in FIG. 3A and FIG. 3B. Here, the sensor 20 arranged at a position closest to the tip of the reed section 11 is a capacitive touch sensor included in the tongue detection section 4, and the sensors 30 to 40 are capacitive touch sensors included in the lip detection section 3. Also, the sensor 40 arranged on the deepest side (that is, heel side) of the reed section 11 has also a function as a temperature sensor. These sensors 20 and 30 to 40 each have an electrode which functions as a sensing pad. Here, the electrodes forming the sensors 30 to 40 have rectangular shapes having substantially the same width and length. The electrodes forming the sensors 30 to 39 are substantially equidistantly arrayed from the tip side to the heel side of the reed section 11.

In FIG. 3B, the case is shown in which the electrodes forming the sensors 30 to 40 each have a rectangular shape. However, the present invention is not limited thereto. Each of the electrodes may have a flat shape, such as a V shape or wave shape. Also, any dimensions and number of the electrodes may be set.

Next, a state of contact between the above-described mouthpiece and the mouth cavity of the instrument player is described.

Figure 4:
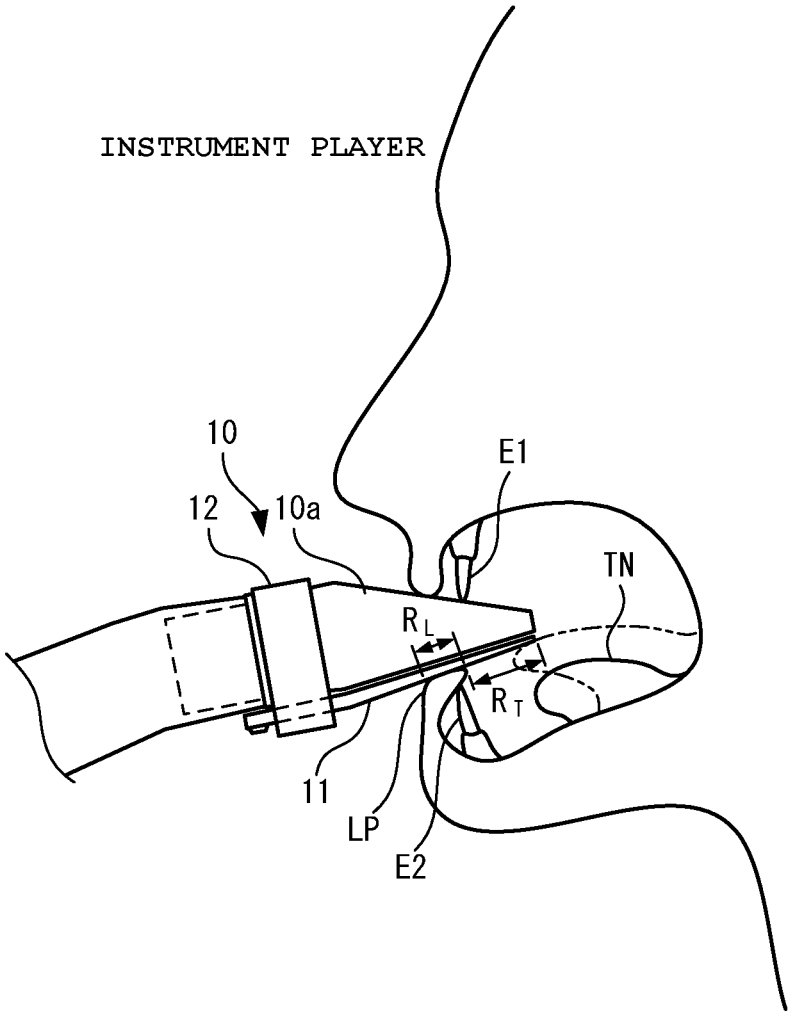
FIG. 4 is a schematic view of a state of contact between the mouth cavity of an instrument player and the mouthpiece.

FIG. 4 is a schematic view of the state of contact between the mouth cavity of the instrument player and the mouthpiece.

At the time of musical performance of the electronic musical instrument 100, the instrument player puts an upper front tooth E1 onto an upper portion of the mouthpiece main body 10*a*, and presses a lower front tooth E2 onto the reed section 11 with the lower front tooth E2 being caught by a lower-side lip (lower lip) LP, as shown in FIG. 4. This causes the mouthpiece 10 to be retained with it being interposed between the upper front tooth E1 and the lip LP from a vertical direction.

Here, based on sensor output values (that is, detection information from the lip detection section 3) outputted from the plurality of sensors 30 to 40 of the lip detection section 3 arrayed on the reed section 11 in accordance with the state of contact of the lip LP, the CPU 5 determines a contact position (lip position) of the lip LP. Then, based on this determined contact position (lip position) of the lip LP, the CPU 5 controls the timbre (pitch) of a musical sound to be emitted. Here, to control the timbre (pitch) so that the feeling of musical performance is made closer to the feeling of blowing of acoustic wind instruments, the CPU 5 estimates a virtual vibration state of the reed section 11 in the mouth cavity based on a distance $R_T$ between two points which are the lip position (strictly, an end of the lip LP inside the mouth cavity) and the end of the reed section 11 on the tip side as shown in FIG. 4, and controls the timbre (pitch) so as to emulate the timbre (pitch) to be emitted based on that virtual vibration state. Also, if the feeling of musical performance is not particularly required to be made closer to the feeling of blowing of acoustic wind instruments, based on a timbre (pitch) set in advance so as to correspond to the contact position (lip position) of the lip LP, the CPU 5 simply performs control so that the timbre (pitch) unique to the electronic wind instrument is emitted.

Also, depending on the musical performance method of the electronic musical instrument 100, a tongue TN inside the mouth cavity at the time of musical performance becomes in either of a state of not making contact with the reed section 11 (indicated by a solid line in the drawing) and a state of making contact with the reed section 11 (indicated by a two-dot-chain line in the drawing), as shown in FIG. 4. Based on sensor output values (that is, detection information from the tongue detection section 4) outputted from the sensor 20 at the end of the reed section 11 on the tip side in accordance with the state of contact of the tongue TN, the CPU 5 judges a performance status of tonguing, which is a musical performance method of stopping vibrations of the reed section 11 by bringing the tongue TN into contact, and controls the note-on (sound emission) or note-off (cancellation of sound emission) of a musical sound.

Also, in the capacitive touch sensors to be applied to the sensors 20 and 30 to 40 arrayed on the reed section 11, it is known that detection values fluctuate due to the effect of moisture and temperature. Specifically, a phenomenon is known in which sensor output values outputted from almost all of the sensors 20 and 30 to 40 increase with an increase in temperature of the reed section 11. This phenomenon is generally called a temperature drift. Here, a change in a temperature status of the reed section 11 occurring during musical performance of the electronic musical instrument 100 is significantly affected by, in particular, the transmission of the body temperature to the reed board 11*a* by the contact of the lip LP. In addition, the change may occur by the state of holding the mouthpiece 10 in the mouth of the instrument player being retained for a long time and the moisture and/or temperature inside the mouth cavity being increased thereby, or by the tongue TN directly coming in contact with the reed section 11 by the above-described tonguing. Thus, based on a sensor output value outputted from the sensor 40 arranged on the deepest side (that is, heel side) of the reed section 11, the CPU 5 judges a temperature status of the reed section 11, and performs processing of offsetting the effect of temperature on sensor output values from the respective sensors 20 and 30 to 40 (removing a temperature drift component).

(Output Characteristics of Lip Detection Section)

Next, output characteristics of the lip detection section 3 in the above-described state in which the instrument player puts the mouthpiece inside the mouth are described. Here, the output characteristics of the lip detection section 3 are described in association with the difference in thickness of the lip of the instrument player. Note that the output characteristics of the lip detection section 3 have similar features in relation to the difference in thickness of the lip, strength of holding the mouthpiece 10 in the mouth, and the like.

Figure 5A:
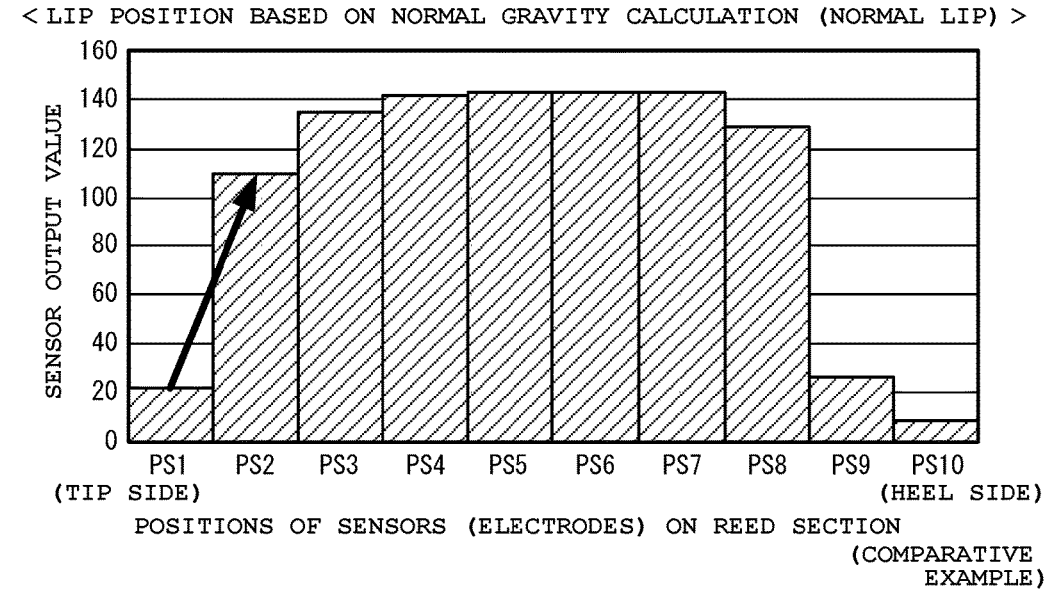
Figure 5B:
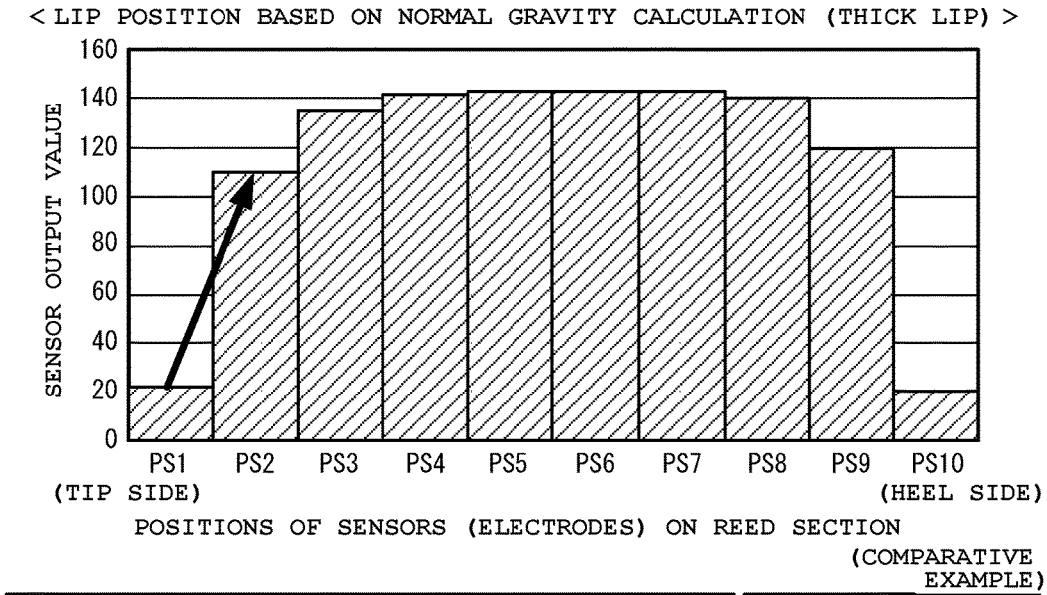

FIG. 5A and FIG. 5B each show an example (comparative example) of the output characteristics of the lip detection section 3 with the mouthpiece 10 being held in the mouth of the instrument player and an example of the calculation of lip positions. Here, FIG. 5A shows an example of distribution of sensor output values from the respective sensors with the mouthpiece 10 being held in the mouth of the instrument player having a lip with a normal thickness, and an example of lip positions calculated based on the example of distribution. FIG. 5B shows an example of distribution of sensor output values from the sensors with the mouthpiece 10 being held in the mouth of the instrument player having a lip thicker than normal, and an example of lip positions calculated based on the example of distribution.

As described above, for the mouthpiece 10 according to the present embodiment, the method has been adopted in which the states of contact of the lip (lower lip) LP and the tongue TN are detected based on the capacitance at the electrode of each of the plurality of sensors 20 and 30 to 40 arrayed on the reed board 11*a*, on a scale of 256 from 0 to 255. Here, since the plurality of sensors 20 and 30 to 40 are arrayed in a line in the longitudinal direction of the reed board 11*a*, in a state in which the instrument player having a lip with a normal (average) thickness ordinarily puts the mouthpiece 10 inside the mouth and is not performing tonguing, the sensor in an area where the lip LP is in contact with the reed section 11 (refer to an area $R_L$ in FIG. 4) and its surrounding sensors (for example, the sensors 31 to 37 at the positions PS2 to PS8) react and their sensor output values indicate high values, as shown in FIG. 5A.

On the other hand, sensor output values from sensors in an area where the lip LP is not in contact (that is, sensors on the tip side and the heel side of the area where the lip LP is in contact, such as the sensors 30, 38, and 39 at the positions PS1, PS9, and PS10) indicate relatively low values. That is, the distribution of sensor output values outputted from the sensors 30, 38, and 39 of the lip detection section 3 has a feature in a mountain shape with peaks indicating that sensor output values from the sensors at the positions where the instrument player brings the lip LP into the strongest contact (roughly, the sensors 34 to 36 at the positions PS5 to PS7) are maximum values, as shown in FIG. 5A.

Note that, in the sensor output distribution charts shown in FIG. 5A and FIG. 5B, the horizontal axis represents positions PS1, PS2, . . . , PS9, and PS10 of the sensors 30, 31, . . . , 38, and 39 arrayed from the tip side toward the heel side on the reed board 11*a*, and the vertical axis represents output values (sensor output values indicating values of eight bits from 0 to 255 acquired by A/D conversion of capacitive values) outputted from the sensors 30 to 39 at the positions PS1 to PS10, respectively.

Here, among the sensors 20 and 30 to 40 arrayed on the reed section 11, sensor output values from the sensors 20 and 40 arranged at both ends at positions closest to the tip and the heel are excluded. The reason for excluding the sensor output value from the sensor 20 is that if that sensor output value indicates a conspicuously high value by tonguing, the effect of the sensor output value from the sensor 20 on correct calculation of a lip position should be eliminated. Also, the reason for excluding the sensor output value from the sensor 40 is that the sensor 40 is arranged on the deepest side (a position closest to the heel) of the mouthpiece 10 and thus the lip LP has little occasion to come in contact with the sensor 40 at the time of musical performance and its sensor output value is substantially unused for calculation of a lip position.

On the other hand, in a state in which the instrument player having a lip thicker than normal ordinarily puts the mouthpiece inside the mouth, the area where the lip LP is in contact with the reed section 11 (refer to the area $R_L$ in FIG. 4) is widened. Thus, the sensors in a range wider than the distribution of sensor output values shown in FIG. 5A (for example, the sensors 31 to 38 at the positions PS2 to PS9) react and their sensor output values indicate high values, as shown in FIG. 5B. In this case as well, the distribution of sensor output values from the sensors 30 to 39 of the lip detection section 3 has a mountain shape with peaks indicating that sensor output values from the sensors at the positions where the instrument player brings the lip LP into the strongest contact (roughly, the sensors 34 to 36 at the positions PS5 to PS7) are maximum values, as shown in FIG. 5B.

(Lip Position Calculation Method)

Firstly, a method is described in which a contact position (lip position) of the lip when the instrument player puts the mouthpiece inside the mouth is calculated based on the distributions of sensor output values such as those shown in FIG. 5A and FIG. 5B.

As a method of calculating a lip position based on the distributions of sensor output values as described above, a general method of calculating a gravity position (or weighted average) can be applied. Specifically, a gravity position $x_G$ is calculated by the following equation (11) based on sensor output values $m_1$ from a plurality of sensors which detect a state of contact of the lip and numbers $x_1$ indicating the positions of the respective sensors.

$$x_G = \frac{\sum_{i=1}^{n} m_i x_i}{\sum_{i=1}^{n} m_i} = \frac{m_1 x_1 + m_2 x_2 + \ldots + m_n x_n}{m_1 + m_2 + \ldots + m_n} \tag{11}$$

In the above equation (11), n is the number of sensor output values for use in calculation of the gravity position $x_G$. Here, as described above, among the sensors 20 and 30 to 40 arrayed on the reed section 11, the sensor output values $m_i$ of ten (n=10) sensors 30 to 39 except the sensors 20 and 40 are used for calculation of the gravity position $x_G$. Also, the position numbers $m_1$ (=1, 2, . . . , 10) are set so as to correspond to positions PS1 to PS10 of these sensors 30 to 39.

When a lip position PS(1-10) is found by calculating the gravity position $x_G$ by using the above equation (11) based on the sensor output values acquired when the instrument player having a lip with a normal thickness puts the mouthpiece 10 inside the mouth as shown in FIG. 5A, a numerical value of "5.10" can be acquired as indicated in a table on the right in the drawing. This numerical value represents the lip position by the sensor position number. That is, this numerical value represents a relative position with respect to the positions PS1 to PS10 of the respective sensors 30 to 39 indicated by position numbers 1 to 10, and this relative position is represented by any of numerical values including decimals of 1.0 to 10.0. Also, Total1 indicated in the drawing is a numerator in the above equation (11), that is, a total sum of the products of the sensor output values $m_1$ and the position numbers $x_G$ in the respective sensors 30 to 39, and Total2 is a denominator in the above equation (11), that is, a total sum of the sensor output values $m_i$ from the respective sensors 30 to 39. When used in the sound source 8, the lip position PS(1-10) in the drawing is converted into a MIDI signal, which is a numerical value represented in seven bits, for use (the positions in the range from the positions PS1 to PS10 are assigned to values from 0 to 27). For example, when the lip position PS(1-10) is "5.10", 1 is subtracted from the lip position PS(1-10), and the result is then multiplied by 127/9. Thus acquired numerical value ((5.10−1)* 127/9=58) represented in seven bits is used as a MIDI signal.

On the other hand, when the calculation of the gravity position $x_G$ by using the above equation (11) is applied to the distribution of the sensor output values acquired when the instrument player having a lip thicker than normal puts the mouthpiece 10 inside the mouth as shown in FIG. 5B as described above, the area where the lip LP is in contact may be widened to cause fluctuations (increase) of the sensor output values in more sensors. This may make it impossible to correctly find a lip position.

Specifically, for an instrument player having a thick lip compared with an instrument player having a lip with a normal thickness, the lip position PS(1-10) is significantly changed from "5.10" to "5.55" (by a difference more than "0.4"), and this makes it impossible to achieve the feeling of blowing and effects of musical sounds intended by the instrument player in sound emission processing described further below. That is, in the example shown in FIG. 5A and FIG. 5B, the thickness of the lip of the instrument player has an effect on determination of the lip position. However, in acoustic wind instruments such as saxophone, musical sounds do not change depending on whether the lip of the instrument player is thick or thin. As shown in FIG. 5A and FIG. 5B, the method of finding a lip position by calculating the gravity position $x_G$ by using the above equation (11) with respect to the distribution of the sensor output values themselves from the respective sensors 30 to 39 is represented as a "comparative example" for convenience.

By contrast, in the present embodiment, for each of the sensors 30 to 39 of the lip detection section 3 arrayed on the reed section 11, a difference between sensor output values of two sensors arrayed adjacent to each other (amount of change between sensor output values) is calculated. Then, based on a plurality of calculated differences between the sensor output values and correlation positions with respect to the array positions of adjacent two sensors corresponding to the plurality of differences, the gravity position $x_G$ (or weighted average) is calculated by using the above equation (11) to be determined as a lip position indicating an end of the lip LP in contact with the reed section 11 inside the mouth cavity (an inner edge portion; a boundary portion of the area where the lip LP is in contact shown in FIG. 4). In the present embodiment, this series of methods is adopted.

(Lip Position Determination Method)

In the following descriptions, a lip position determination method to be applied to the present embodiment is described in detail.

FIG. 6A and FIG. 6B each show an example (present embodiment) of change characteristics of detection information regarding the lip detection section with the mouthpiece being held in the mouth of the instrument player and an example of the calculation of a lip position. Here, FIG. 6A shows an example of the distribution of differences of sensor output values from adjacent two sensors with the mouthpiece being held in the mouth of the instrument player having a lip with a normal thickness, and an example of lip positions calculated based on the example of distribution. FIG. 5B shows an example of the distribution of differences of sensor output values from adjacent two sensors with the mouthpiece being held in the mouth of the instrument player having a lip thicker than normal, and an example of lip positions calculated based on the example of distribution.

In the lip position determination method to be applied to the present embodiment, firstly, in the distribution of the sensor output values from the respective sensors 30 to 39 shown in FIG. 5A or FIG. 5B, differences ($m_1+1-m_i$) between sensor output values in the combinations of two sensors arranged adjacent to each other, that is, the sensors 30 and 31, 31 and 32, 32 and 33, . . . , 37 and 38, and 38 and 39, are calculated. Here, as differences between sensor output values, nine (=n−1) differences are calculated for ten (n=10) sensors 30 to 39, and are represented by Dif(31−30), Dif(32−31), Dif(33−32), . . . , Dif(38−37), and Dif(39−38) for convenience. In particular, in the present embodiment, only an increase portion in the distribution of the sensor output values shown in FIG. 5A or FIG. 5B is extracted as a difference between the sensor output values. When a difference between sensor output values takes a minus value, the difference is set at "0". Thus calculated distribution of the differences between the sensor output values is represented as shown in FIG. 6A or FIG. 6B.

Here, in the distribution charts of the differences of the sensor output values shown in FIG. 6A or FIG. 6B, the horizontal axis represents representative positions (correlation positions) DF1, DF2, DF3, . . . , DF8, and DF9 in combinations of two sensors 30 and 31, 31 and 32, 32 and 33, . . . , 37 and 38, and 38 and 39 arranged adjacent to each other. Here, as one example of the representative positions DF1 to DF9 in the respective combinations of two sensors, representative positions (correlation positions) in the respective combinations at the sensor on the tip side of two sensors are represented. However, these representative positions are only required to each represent a correlated position with respect to the array positions of two sensors adjacently arranged. Therefore, these representative positions may be positions each represented by a distance from an intermediate position or gravity position of two sensors or a reference position separately set. Also, the vertical axis represents differences between the sensor output values in the respective combinations of two sensors 30 and 31, 31 and 32, 32 and 33, . . . , 37 and 38, and 38 and 39 arranged adjacent to each other.

Then, based on the differences of the sensor output values in the distribution such as those shown in FIG. 6A or FIG. 6B, the gravity position $x_G$ is calculated by using the above equation (11) to determine a lip position PS(DF). In the present embodiment, the lip position PS(DF) is substantially "1.35" as indicated in a table on the right in each drawing, and equal or equivalent numerical values have been acquired. That is, in the present embodiment, it has been confirmed that the lip position PS can be more correctly calculated while hardly receiving the effect of the thickness of the lip of the instrument player. Similarly, although detailed description is omitted, it has been confirmed that calculation can be made while hardly receiving not only the above-described influence of the thickness of the lip of the instrument player but also the influence of the hardness of the lip, the strength of holding the mouthpiece in the mouth, and the like.

Here, Total1 shown in FIG. 6A or FIG. 6B represents a total sum of the products of differences Dif(31−30), Dif(32−31), Dif(33−32), . . . , Dif(38−37), and Dif(39−38) between the sensor outputs values in the combinations of two sensors 30 and 31, 31 and 32, 32 and 33, . . . , 37, and 38, and 38 and 39 arranged adjacent to each other and a position number $x_1$ indicative of positions DF1, DF2, DF3, . . . , DF8, and DF9 correlated to the array positions of the adjacent two sensors corresponding to the differences between the sensor output values in the combinations. Also, Total2 is a total sum of the differences Dif(31−30), Dif(32−31), Dif(33−32), . . . , Dif(38−37), and Dif(39−38) in the combinations of adjacent two sensors.

In the present embodiment, as in the next equation (12), these Total1 and Total2 are applied to the numerators and the denominators in the above equation (11) to calculate the gravity position $x_e$ as the lip position PS(DF).

$$PS(DF)=x_G=\text{Total1}/\text{Total2} \tag{12}$$

That is, in the distribution of the sensor output values in a mountain shape such as those shown in FIG. 5A or FIG. 5B, when changes in the sensor output values between sensors adjacent to each other are monitored, in a characteristic change portion where the sensor output values abruptly increase (corresponding to a steep portion on the left in the distribution in a mountain shape indicated by a bold line in the drawing), the difference between the sensor output values between the adjacent two sensors indicates a large value as shown in FIG. 6A or FIG. 6B. The portion indicating this large value of difference indicates a characteristic behavior also when a gravity position (or weighted average) is calculated by using equation (11).

Thus, in the present embodiment, of the plurality of sensors, each difference between output values of two sensors arrayed adjacent to each other is calculated and with each calculated difference between the output values taken as a weighting value when a gravity position or weighted average is calculated, a gravity position or weighted average of positions correlated to the array positions of the adjacent two sensors (correlation positions) and corresponding to the plurality of differences is calculated.

This specifies a position corresponding to the steep portion on the left of the distribution in the mountain shape of the sensor output values by the above equation (12), thereby allowing the lip position PS(DF) indicating the end (inner edge portion) of the lip LP inside the mouth cavity in contact with the reed portion 11 to be easily judged and determined.

The position calculated by using the above equation (12) indicates a relative position with respect to each sensor array. When the emission of a musical sound is to be controlled based on the change of the lip position PS, this value can be used as it is. Also, when the emission of a musical sound is to be controlled based on the absolute lip position such as the position of an end of the lip in contact with the reed, an offset value found in advance in an experiment is added to (or subtracted from) this relative position for conversion to an absolute value.

In the present embodiment, the method has been described in which, when the lip position PS(DF) is determined, the sensors 20 and 40 are excluded from the sensors 20 and 30 to 40 arrayed on the reed section 11 and the sensor output values from ten sensors 30 to 39 are used. However, the present invention is not limited thereto. That is, in the present invention, a method may be applied in which only the sensor 20 of the tongue detection section 4 is excluded and the sensor output values from eleven sensors 30 to 40 of the lip detection section 3 are used.

<Electronic Musical Instrument Control Method>

Next, a control method for the electronic musical instrument to which the lip position determination method according to the present embodiment has been applied is described. Here, the electronic musical instrument control method according to the present embodiment is achieved by the CPU 5 of the electronic musical instrument 100 described above executing a control program including a specific processing program of the lip detection section.

Figure 7:
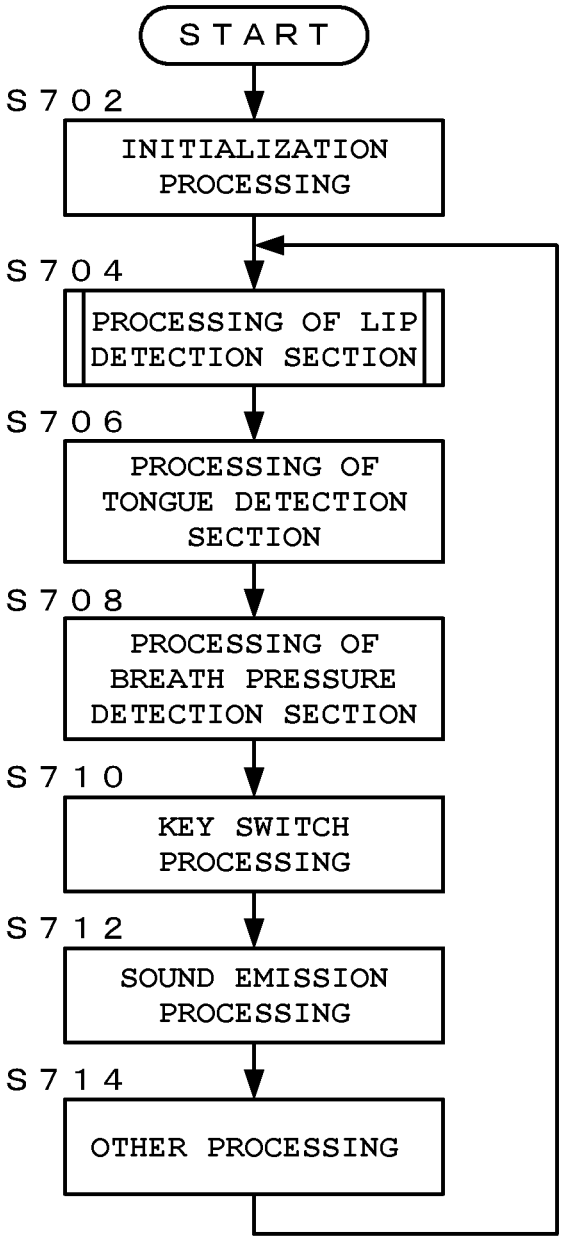
FIG. 7 is a flowchart of the main routine of a control method in the electronic musical instrument according to the embodiment.

FIG. 7 is a flowchart of the main routine of the control method in the electronic musical instrument according to the present embodiment.

In the electrical musical instrument control method according to the present embodiment, first, when an instrument player (user) turns a power supply of the electronic musical instrument 100 on, the CPU 5 performs initialization processing of initializing various settings of the electronic musical instrument 100 (Step S702), as in the flowchart shown in FIG. 7.

Next, the CPU 5 performs processing based on detection information regarding the lip (lower lip) LP outputted from the lip detection section 3 by the instrument player holding the mouthpiece 10 of the electronic musical instrument 100 in one's mouth (Step S704). This processing of the lip detection section 3 includes the above-described lip position determination method, and will be described in detail further below.

Next, the CPU 5 performs processing based on detection information regarding the tongue TN outputted from the tongue detection section 4 in accordance with the state of contact of the tongue TN with the mouthpiece 10 (Step S706). Also, the CPU 5 performs processing based on breath pressure information outputted from the breath pressure detection section 2 in accordance with a breath blown into the mouthpiece 10 (Step S708).

Next, the CPU 5 perform key switch processing of generating a keycode in accordance with pitch information included in operation information regarding the operators 1 and supplying it to the sound source 8 so as to set the pitch of a musical sound (Step S710). Here, the CPU 5 performs processing of setting timbre effects (for example, a pitch bend and vibrato) by adjusting the timbre, sound volume, and pitch of the musical sound based on the lip position calculated by using the detection information regarding the lip LP inputted from the lip detection section 3 in the processing of the lip detection section 3 (Step S704). Also, the CPU 5 performs processing of setting the note-on/note-off of the musical sound based on the detection information regarding the tongue TN inputted from the tongue detection section 4 in the processing of the tongue detection section 4

(Step S706), and perform processing of setting the sound volume of the musical sound based on the breath pressure information inputted from the breath pressure detection section 2 in the processing of the breath pressure detection section 2 (Step S708). By this series of processing, the CPU 5 generates an instruction for generating the musical sound in accordance with the musical performance operation of the instrument player for output to the sound source 8. Then, based on the instruction for generating the musical sound from the CPU 5, the sound source 8 performs sound emission processing of causing the sound system 9 to operate (Step S712).

Then, after the CPU 5 performs other necessary processing (Step S714) and ends the series of processing operations, the CPU 5 repeatedly performs the above-described processing from Steps S704 to S714. Although omitted in the flowchart shown in FIG. 7, when a state change such as an end or interruption of the musical performance is detected during the above-described series of processing operations (Steps S702 to S714), the CPU 5 terminates these processing operations.

(Processing of Lip Detection Section)

Next, the processing of the lip detection section 3 shown in the above-described main routine is described.

Figure 8:
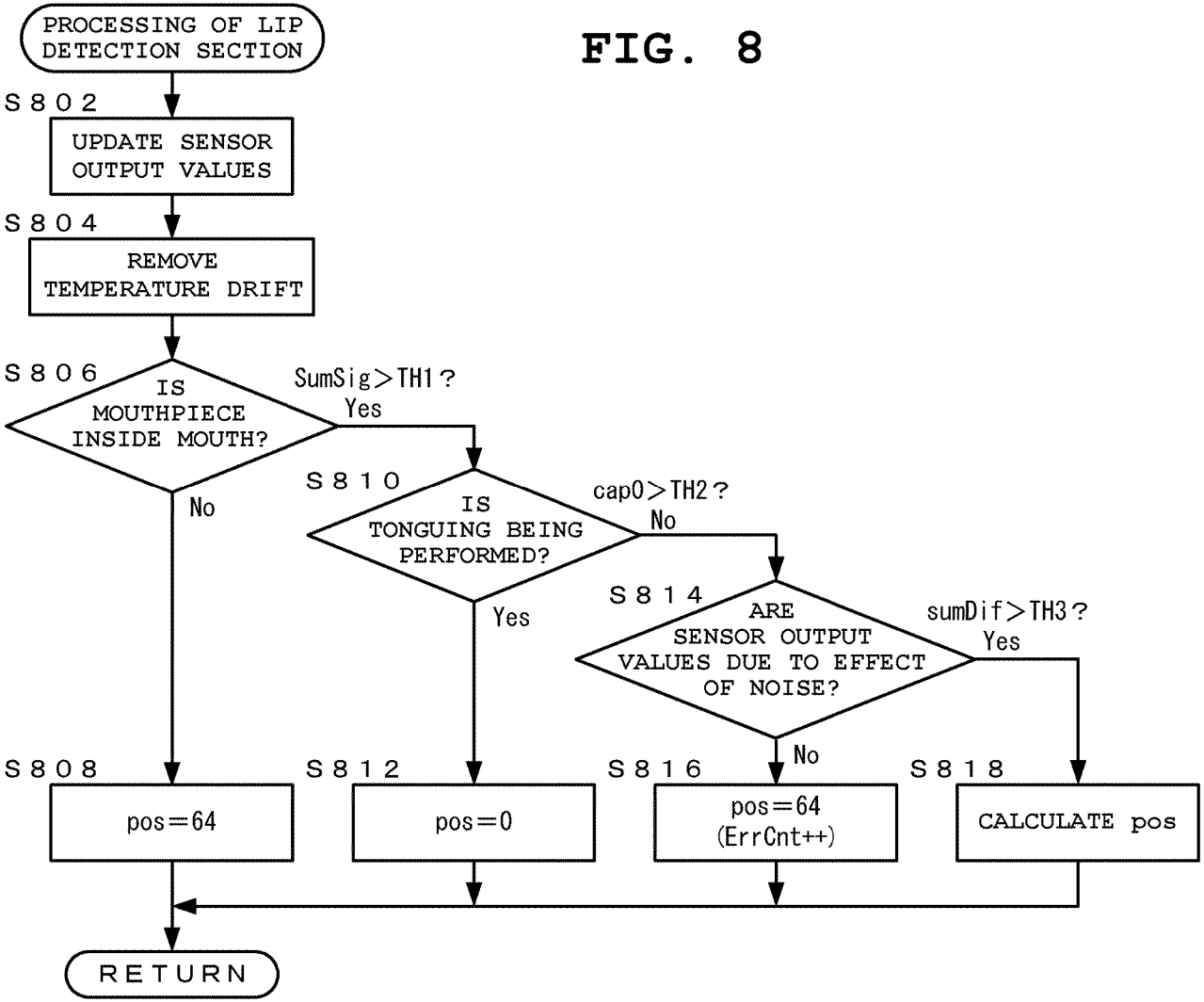
FIG. 8 is a flowchart of processing of the lip detection section to be applied to the control method for the electronic musical instrument according to the embodiment.

FIG. 8 is a flowchart of the processing of the lip detection section to be applied to the control method for the electronic musical instrument according to the present embodiment.

In the processing of the lip detection section 3 to be applied to the electronic musical instrument control method shown in FIG. 7, first, the CPU 5 acquires sensor output values outputted from the plurality of sensors 20 and 30 to 40 arrayed on the reed section 11 and causes the sensor output values to be stored in a predetermined storage area of the RAM 7 as current output values, as shown in the flowchart of FIG. 8. This causes the sensor output values stored in the predetermined storage area of the RAM 7 to be sequentially updated to the current sensor output values (Step S802).

Next, based on the sensor output value outputted from the sensor 40 arranged on the deepest side (that is, heel side) of the reed section 11, the CPU 5 performs processing of judging a temperature status of the reed section 11 and offsetting the effect of temperature on the sensor output values from the respective sensors 20 and 30 to 40. As described above, it is known in capacitive touch sensors that a detection value fluctuates due to the effect of moisture and temperature. Accordingly, with an increase in temperature of the reed section 11, a temperature drift occurs in which the sensor output values outputted from almost all of the sensors 20 and 30 to 40 increase. Thus, in the present embodiment, by performing processing of subtracting a predetermined value (for example, a value on the order of "100" at maximum) corresponding to the temperature drift from all of the sensor output values, the effect of the temperature drift due to an increase in moisture and temperature within the mouth cavity is eliminated (Step S804).

Next, based on the sensor output values (current output values) outputted from the sensors 30 to 40 of the lip detection section 3, the CPU 5 judges whether the instrument player is currently holding the mouthpiece 10 in one's mouth (Step S806). Here, as a method of judging whether the instrument player is holding the mouthpiece 10 in one's mouth, for example, a method of judgment by using a total sum of the sensor output values (strictly, a total sum of the output values after the above-described temperature drift removal processing; represented as "SumSig" in FIG. 8) of ten sensors 30 to 39 (or eleven sensors 30 to 40) can be applied, as shown in FIG. 8. That is, when the calculated total sum of the sensor output values exceeds a predetermined threshold TH1 (SumSig>TH1), the CPU 5 judges that the instrument player is holding the mouthpiece 10 in one's mouth. When the calculated value is equal to or smaller than the above-described threshold TH1 (SumSig≤TH1), the CPU 5 judges that the instrument player is not holding the mouthpiece 10 in one's mouth. In the present embodiment, for example, a value in a range of 70% to 80% of the total sum of the sensor output values from the sensors 30 to 39 (or the sensor 30 to 40) (SumSig×70-80%) is set as the threshold TH1.

When judged at Step S806 that the instrument player is not holding the mouthpiece 10 in one's mouth (No at Step S806), the CPU 5 does not calculate a lip position (represented as "pos" in FIG. 8), sets a default value ("pos=64") (Step S808), and ends the processing of the lip detection section 3 to return to the main routine shown in FIG. 7.

Conversely, when judged at Step S806 that the instrument player is holding the mouthpiece 10 in one's mouth (Yes at Step S806), the CPU 5 judges, based on the sensor output value (current output value) outputted from the sensor 20 of the tongue detection section 4, whether the instrument player is currently performing tonguing (Step S810). Here, as a method of judging whether tonguing is being performed, for example, the following method can be applied, as shown in FIG. 8. That is, the CPU 5 judges that tonguing is being performed when the sensor output value of the sensor 20 (precisely, an output value after the temperature drift removal processing; represented as "cap0" in FIG. 8) exceeds a predetermined threshold TH2 (cap0>TH2), and judges that tonguing is not being performed when the sensor output value is equal to or smaller than the threshold TH2 (cap0≤TH2). In the present embodiment, for example, a value on the order of "80" is set as the threshold TH2.

When judged at Step S810 that the instrument player is performing tonguing (Yes at Step S810), the CPU 5 judges that the tongue TN is in contact with the sensor 20 arranged at the end of the reed section 11 on the tip side. Therefore, the CPU 5 does not calculate a lip position (pos), sets "pos=0" (Step S812), and ends the processing of the lip detection section 3 to return to the processing of the main routine shown in FIG. 7.

Conversely, when judged at Step S810 that the instrument player is not performing tonguing (No at Step S810), the CPU 5 judges whether the sensor output values (current output value) outputted from the sensors 30 to 39 of the lip detection section 3 are due to the effect of noise (Step S814). Here, as a method of judging whether the sensor output values are due to the effect of noise, for example, the following method can be applied, as shown in FIG. 8. That is, in the sensors 30 to 39, a judgment is made by using a total sum of differences between sensor output value between adjacent two sensors (a total sum of differences between output values after the above-described temperature drift removal processing; represented as "sumDif" in the drawing). That is, when the calculated total sum of the differences between the sensor output values exceeds a predetermined threshold TH3 (sumDif>TH3), the CPU 5 judges that the sensor output values outputted from the sensors 30 to 39 are not due to the effect of noise. When the calculated value is equal to or smaller than the threshold TH3 (sumDif≤TH3), the CPU 5 judges that the sensor output values are due to the effect of noise. In the present embodiment, for example, a value on the order of 80% of the total sum of the differences between the sensor output values between adjacent two sensors (sumDif×80%) is set as the threshold TH3.

When judged at Step S514 that the sensor output values outputted from the sensors 30 to 39 are due to the effect of noise (Yes at Step S814), the CPU 5 does not calculate a lip position (pos), sets a default value ("pos=64"), and adds a value for recording a situation of error occurrence (represented as "ErrCnt" in the drawing) for storage (Step S816). The CPU 5 then ends the processing of the lip detection section 3, and returns to the processing of the main routine shown in FIG. 7.

The state in which the total sum of the differences between the sensor output values between adjacent two sensors is equal to or smaller than the threshold TH3 (sumDif≤TH3; Yes at Step S814) such as that shown at Step S814 occurs not only due to the effect of noise but also, for example, when the instrument player puts the mouthpiece 10 inside the mouth intentionally in an abnormal manner or when an anomaly in hardware occurs in a sensor itself.

On the other hand, when judged at Step S814 that the sensor output values outputted from the sensors 30 to 39 are not due to the effect of noise (No at Step S814), the CPU 5 calculates a lip position (pos) based on the above-described lip position determination method (Step S818). That is, the CPU 5 calculates each difference between the sensor output values between the sensor arranged adjacent to each other, and records that value as Dif(mi+1−mi). The CPU 5 then calculates a gravity position or weighted average based on the distribution of these difference values Dif(mi+1−mi) with respect to the positions correlated to the array positions of the two sensors corresponding to each difference between the sensor output values (in other words, the distribution of frequencies and weighted values, which are output value at the array positions of the sensors), thereby determining a lip position indicating an inner edge portion of the lip LP in contact with the reed section 11.

As such, in the present embodiment, by calculating a gravity position or weighted average by using a predetermined arithmetic expression based on the distribution of the differences between the sensor output values between adjacent two sensors in the sensor output values acquired from the plurality of sensors 30 to 39 of the lip detection section 3 arrayed on the reed section 11 with the mouthpiece 10 of the electronic musical instrument 100 being held in the mouth, a position where the sensor output value characteristically increases is specified and determined as a lip position.

Thus, according to the present embodiment, it is possible to determine a more correct lip position while hardly receiving the effect of the thickness and hardness of the lip of the instrument player, the strength of holding the mouthpiece in the mouth, and the like, and changes in musical sounds can be made closer to the feeling of musical performance and effects of musical sounds (for example, a pitch bend and vibrato) in acoustic wind instruments.

In the present embodiment, the method has been described in which a lip position is determined by calculating a gravity position or weighted average based on the distribution of differences between output values between two sensors arrayed adjacent to each other with respect to positions (correlation positions) correlated to the array positions of the above-described two sensors among a plurality of sensors. However, the present invention is not limited thereto. That is, by taking the correlation positions corresponding to the above-described plurality of differences as series in frequency distribution and taking differences between output value corresponding to the plurality of differences as frequencies in the frequency distribution, any of various average values (including weighted average described above), a median value, and a mode value indicating statistics in the frequency distribution may be calculated and a lip position may be determined based on the calculated statistic.

(Modification Example)

Next, a modification example of the above-described electronic musical instrument control method according to the present embodiment is described. Here, the outer appearance and the functional structure of the electronic musical instrument to which the present modification example has been applied are equivalent to those of the above-described embodiment, and therefore their description is omitted.

Figure 9:
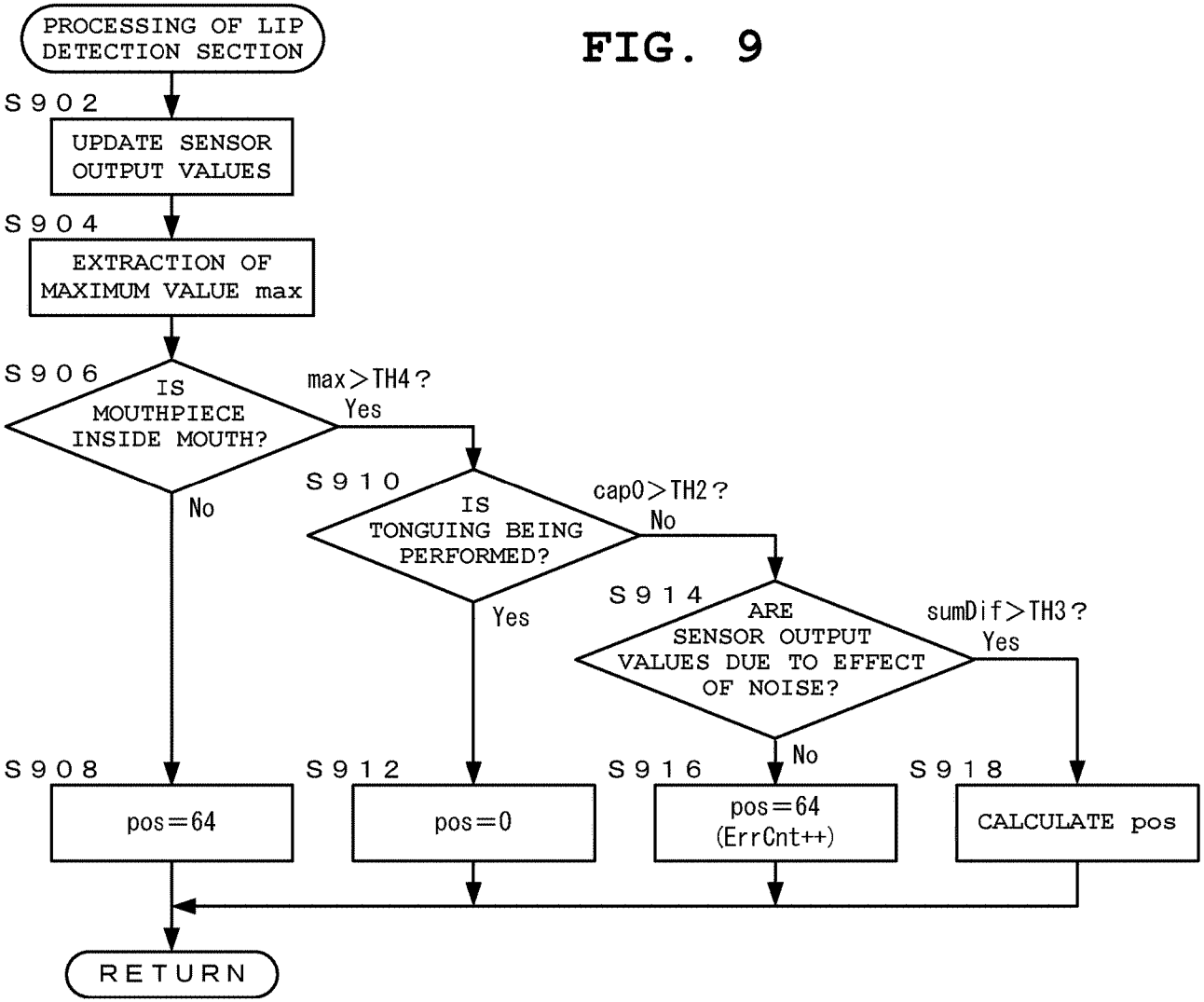
FIG. 9 is a flowchart of a modification example of the control method for the electronic musical instrument according to the embodiment.

FIG. 9 is a flowchart of the modification example of the control method for the electronic musical instrument according to the present embodiment.

The electronic musical instrument control method according to the present modification example is applied to the processing (Step S704) of the lip detection section in the main routine shown in the flowchart of FIG. 7 and, in particular, is characterized in a method of judging whether the instrument player is holding the mouthpiece in one's mouth and a lip position determination method. In the flowchart shown in FIG. 9, Steps S908 to S916 are equivalent to Steps S808 to S816 of the flowchart shown in FIG. 8, and therefore their detailed descriptions are omitted.

In the present modification example, first, the CPU 5 acquires sensor output values outputted from the plurality of sensors 20 and 30 to 40 arrayed on the reed section 11 so as to update sensor output values stored in the RAM 7 (Step S902), as with the above-described embodiment. Next, the CPU 5 extracts a sensor output value as a maximum value (max) from the acquired sensor output values from the sensors 30 to 39 (or 30 to 40) of the lip detection section 3 (Step S904), and judges, based on the maximum value, whether the instrument player is holding the mouthpiece 10 in one's mouth (Step S906). Here, as a method of judging whether the instrument player is holding the mouthpiece 10 in one's mouth, the CPU 5 judges that the instrument player is holding the mouthpiece 10 in one's mouth when the extracted maximum value exceeds a predetermined threshold TH4 (max>TH4), and judges that the instrument player is not holding the mouthpiece 10 in one's mouth when the maximum value is equal to or smaller than the threshold TH4 (max≤TH4), as shown in FIG. 9. In this modification example, for example, a value of 80% of the extracted maximum value (max×80%) is set as the threshold TH4.

The method for a judgment as to whether the instrument player is holding the mouthpiece 10 in one's mouth is not limited to the methods described in the present modification example and the above-described embodiment, and another method may be applied. For example, for the above-described judgment, a method may be applied in which the CPU 5 judges that the instrument player is not holding the mouthpiece 10 in one's mouth when all sensor output values outputted from the sensors 30 to 39 are equal to or smaller than a predetermined value and judges that the instrument player is holding the mouthpiece 10 in one's mouth when more than half of the sensor output values exceed the predetermined value.

Next, when judged that the instrument player is not holding the mouthpiece 10 in one's mouth (No at Step S906), the CPU 5 sets a default value ("pos=64") as a lip position (Step S908), as with the above-described embodiment. When judged that the instrument player is holding the mouthpiece 10 in one's mouth (Yes at Step S906), the CPU 5 judges, based on the sensor output value outputted from the sensor 20 of the tongue detection section 4, whether the instrument player is performing tonguing (Step S910). When judged that the instrument player is performing tonguing (Yes at Step S910), the CPU 5 sets the lip position as "pos=0" (Step S912). When judged that the instrument player is not performing tonguing (No at Step S910), the CPU 5 judges whether the sensor output values are due to the effect of noise (Step S914). When judged that the sensor output values are due to the effect of noise (Yes at Step S914), the CPU 5 sets a default value ("pos=64") as a lip position (Step S916). When judged that the sensor output values are not due to the effect of noise (No at Step S914), the CPU 5 calculates a lip position (Step S918).

Here, as described in the above-described embodiment, the lip position may be determined by calculating a gravity position or weighted average based on the distribution of differences between sensor output values between adjacent two sensors, or by applying another method. For example, the following method may be adopted. That is, differences between sensor output values between two sensors arranged adjacent to each other are calculated and recorded as Dif ($mi+1-mim_i+1-m_i$), and a difference as a maximum value Dif(max) is extracted from the distribution of these difference values. Then, a lip position is determined based on positions (correlation positions) correlated to array positions of two sensors corresponding to the difference as the maximum value Dif(max), such as an intermediate position or gravity position between the array positions of two sensors. Also, in another method, when the extracted maximum value Dif(max) exceeds a predetermined threshold TH5, a lip position may be determined based on positions correlated to array positions of two sensors corresponding to the difference as the maximum value Dif(max).

In this electronic musical instrument control method as well, in the distribution of the sensor output values acquired from the plurality of sensors 30 to 39 arrayed on the reed section 11 with the mouthpiece 10 of the electronic musical instrument 100 being held in the mouth, a position where the sensor output value characteristically increases can be specified based on the differences between the sensor output values between two sensors arranged adjacent to each other. This allows a more correct lip portion to be determined as hardly receiving the effect of the thickness and hardness of the lip of the instrument player, the strength of holding the mouthpiece in the mouth, and the like.

In the above-described embodiment and modification example, the method has been described in which a position where the sensor output value characteristically increases is specified in the distribution of the sensor output values from the plurality of sensors 30 to 39 of the lip detection section 3 and is determined as a lip position indicating an inner edge portion of the lip LP in contact with the reed section 11. However, for implementation of the present invention, based on a similar technical idea, a method may be adopted in which a position of a characteristic change portion where the sensor output values abruptly decrease is specified in the distribution of the sensor output values from the plurality of sensors of the lip detection section 3 and is determined as a lip position indicating an end of the lip LP in contact with the reed section 11 outside the mouth cavity (an outer edge portion; a boundary portion of the area $R_L$ in contact with the lip LP outside the mouth cavity).

Furthermore, in the above-described embodiment, when a lip position is to be determined, a correction may be made with reference to a lip position indicating an inner edge portion of the lip LP determined based on the distribution of the sensor output values from the plurality of sensors 30 to 39 of the lip detection section 3, by shifting the position (adding or subtracting an offset value) to a direction on the depth side (heel side) by a thickness of the lip (lower lip) LP set in advance or, for example, a predetermined dimension corresponding to a half of that thickness. According to this, the lip position indicating the outer edge portion of the lip LP or the center position of the thickness of the lip can be easily judged and determined.

Still further, in the above-described embodiment, the electronic musical instrument 100 has been described which has a saxophone-type outer appearance. However, the electronic musical instrument according to the present invention is not limited thereto. That is, the present invention may be applied to an electronic musical instrument (electronic wind instrument) that is modeled after another acoustic wind instrument such as a clarinet and held in the mouth of the instrument player for musical performance similar to that of an acoustic wind instrument using a reed.

Also, in some recent electronic wind instruments structured to have a plurality of operators for musical performance which are operated by a plurality of fingers, for example, a touch sensor is provided to the position of the thumb, and effects of generated musical sound and the like are controlled in accordance with the position of the thumb detected by this touch sensor. In these electronic wind instruments as well, the detection device and detection method for detecting an operation position according to the present invention may be applied, in which a plurality of sensors which detect a contact status or proximity status of a finger are arrayed at positions operable by one finger and an operation position by one finger is detected based on a plurality of detection values detected by the plurality of sensors.

Also, not only in electronic musical instruments but also in electronic devices which performs operations by using part of the human body, the detection device and detection method for detecting an operation position according to the present invention may be applied, in which a plurality of sensors which detect a contact status or proximity status of part of the human body are provided at positions operable by part of the human body, and an operation position by part of the human body is detected based on a plurality of detection values detected by the plurality of sensors.

Furthermore, the above-described embodiment is structured such that a plurality of control operations are performed by the CPU (general-purpose processor) executing a program stored in the ROM (memory). However, in the present embodiment, each control operation may be separately performed by a dedicated processor. In this case, each dedicated processor may be constituted by a general-purpose processor (electronic circuit) capable of executing any program and a memory having stored therein a control program tailored to each control, or may be constituted by a dedicated electronic circuit tailored to each control.

Still further, the structures (functions) of the device required to exert various effects described above are not limited to the structures described above, and the following structures may be adopted.

(Structure Example 1)

A detection device structured to comprising:

n number of sensors arrayed in a direction, in which n is an integer of 3 or more and from which (n−1) pairs of adjacent sensors are formed; and a processor which determines one specified position in the direction based on output values of the n number of sensors, wherein the processor calculates (n−1) sets of difference values each of which is a difference between two output values corresponding to each of the (n−1) pairs of sensors, and determines the one specified position based on the (n−1) sets of difference values and correlation positions corresponding to the (n−1) sets of difference values and indicating positions correlated with array positions of each pair of sensors.

(Structure Example 2)

The detection device of Structure Example 1, wherein the processor calculates a weighted average of the correlation positions corresponding to the (n−1) sets of difference values by taking the (n−1) sets of difference values as weighting values for calculating the weighted average, and determines the one specified position based on the calculated weighted average.

(Structure Example 3)

The detection device of Structure Example 1, wherein the processor, by taking the correlation positions corresponding to the (n−1) sets of difference values as series in frequency distribution and taking the (n−1) sets of difference values as frequencies in the frequency distribution, calculates any one of an average value, a median value, and a mode value indicating statistics in the frequency distribution, and determines the one specified position based on the calculated statistic.

(Structure Example 4)

The detection device of Structure Example 3, wherein the processor calculates an average value in the frequency distribution, and determines the one specified position based on the calculated average value.

(Structure Example 5)

The detection device of Structure Example 3, wherein the one specified position determined based on the correlation positions is a position of a change portion where the output values abruptly increase or decrease in the frequency distribution, and corresponds to an end serving as a boundary of the one specified position having an area spreading in the direction.

(Structure Example 6)

The detection device of Structure Example 1, wherein the processor corrects the one specified position by adding or subtracting a set offset value to or from the one specified position determined based on the correlation positions.

(Structure Example 7)

The detection device of Structure Example 1, wherein the processor judges a temperature status in the n number of sensors based on an output value of a specific sensor selected from a plurality of sensors and determines, after performing processing of removing a component related to temperature from each of the output values of the plurality of sensors, the one specified position based on output values of the n number of sensors excluding the specific sensor.

(Structure Example 8)

The detection device of Structure Example 1, further comprising:

a mouthpiece which is put in a mouth of an instrument player, wherein a plurality of sensors are arrayed from one end side toward an other end side of a reed section of the mouthpiece and each detect a contact status of a lip, and wherein the processor calculates the (n−1) sets of difference values with the n number of sensors selected from the plurality of sensors as targets.

(Structure Example 9)

An electronic musical instrument comprising:

a sound source which generates a musical sound;

n number of sensors arrayed in a direction, in which n is an integer of 3 or more and from which (n−1) pairs of adjacent sensors are formed; and a processor which determines one specified position in the direction based on output values of the n number of sensors, wherein the processor calculates (n−1) sets of difference values each of which is a difference between two output values corresponding to each of the (n−1) pairs of sensors, determines the one specified position based on the (n−1) sets of difference values and correlation positions corresponding to the (n−1) sets of difference values and indicating positions correlated with array positions of each pair of sensors, and controls the musical sound that is generated by the sound source, based on the one specified position.

While the present invention has been described with reference to the preferred embodiments, it is intended that the invention be not limited by any of the details of the description therein but includes all the embodiments which fall within the scope of the appended claims.

What is claimed is:

1. A detection device comprising:

n number of sensors arrayed in a direction, where n is an integer of 3 or more and from which (n−1) pairs of adjacent sensors are formed; and a processor which determines one specified position in the direction based on output values of the n number of sensors, wherein the processor calculates (n−1) sets of difference values each of which is a difference between two output values corresponding to each of the (n−1) pairs of sensors, and determines the one specified position based on the (n−1) sets of difference values and correlation positions corresponding to the (n−1) sets of difference values and indicating positions correlated with array positions of each pair of sensors, and wherein the processor judges a temperature status in the n number of sensors based on an output value of a specific sensor selected from a plurality of the n number of sensors and determines, after performing processing of removing a component related to temperature from each of the output values of the plurality of sensors, the one specified position based on output values of the n number of sensors excluding the specific sensor.

2. The detection device according to claim 1, wherein the processor calculates a weighted average of the correlation positions corresponding to the (n−1) sets of difference values by taking the (n−1) sets of difference values as weighting values for calculating the weighted average, and determines the one specified position based on the calculated weighted average.

3. The detection device according to claim 1, wherein the processor, by taking the correlation positions corresponding to the (n−1) sets of difference values as a series in frequency distribution and taking the (n−1) sets of difference values as frequencies in the frequency distribution, calculates any one of an average value, a median value, and a mode value indicating statistics in the frequency distribution, and determines the one specified position based on the calculated statistic.

4. The detection device according to claim 3, wherein the processor calculates an average value in the frequency distribution, and determines the one specified position based on the calculated average value.

5. The detection device according to claim 3, wherein the one specified position determined based on the correlation positions is a position of a change portion where the output values abruptly increase or decrease in the frequency distribution, and corresponds to an end serving as a boundary of the one specified position having an area spreading in the direction.

6. The detection device according to claim 1, wherein the processor corrects the one specified position by adding or subtracting a set offset value to or from the one specified position determined based on the correlation positions.

7. A detection device comprising:

n number of sensors arrayed in a direction, where n is an integer of 3 or more and from which (n−1) pairs of adjacent sensors are formed;

a processor which determines one specified position in the direction based on output values of the n number of sensors; and a mouthpiece which is held in a mouth of an instrument player, wherein the processor calculates (n−1) sets of difference values each of which is a difference between two output values corresponding to each of the (n−1) pairs of sensors, and determines the one specified position based on the (n−1) sets of difference values and correlation positions corresponding to the (n−1) sets of difference values and indicating positions correlated with array positions of each pair of sensors, wherein a plurality of the sensors are arrayed from a first end side toward a second end side of a reed section of the mouthpiece and each detects a contact status of a lip, and wherein the processor calculates the (n−1) sets of difference values with the n number of sensors selected from the plurality of sensors as targets.

8. An electronic musical instrument comprising:

a sound source which generates a musical sound;

n number of sensors arrayed in a direction, where n is an integer of 3 or more and from which (n−1) pairs of adjacent sensors are formed; and a processor which determines one specified position in the direction based on output values of the n number of sensors, wherein the processor calculates (n−1) sets of difference values each of which is a difference between two output values corresponding to each of the (n−1) pairs of sensors, determines the one specified position based on the (n−1) sets of difference values and correlation positions corresponding to the (n−1) sets of difference values and indicating positions correlated with array positions of each pair of sensors, and controls the musical sound that is generated by the sound source, based on the one specified position, wherein the electronic musical instrument is an electronic wind instrument having a mouthpiece, and wherein the n number of sensors are arrayed on a reed section of the mouthpiece and detect a lip of an instrument player.

9. The electronic musical instrument according to claim 8, wherein:

the n number of sensors are arrayed on the reed section from a first end side toward a second end side, and the processor determines a contact position of the lip on the reed section in the direction from the first end side toward the second end side based on the output values of the n number of sensors, and controls musical sound generation based on the determined contact position of the lip.

10. The electronic musical instrument according to claim 9, wherein an operation position determined based on the correlation positions is a position of a change portion where the output values of the plurality of sensors abruptly increase or decrease, and corresponds to an end serving as a boundary of the contact position of the lip having an area spreading in the direction from the first end side toward the second end side.

11. The electronic musical instrument according to claim 10, wherein the processor corrects the contact position of the lip by adding or subtracting a set offset value to or from the one specified position determined based on the correlation positions.

12. A detection method for an electronic device, comprising:

acquiring output values from n number of sensors arrayed in a direction, where n is an integer of 3 or more and from which (n−1) pairs of adjacent sensors are formed;

calculating (n−1) sets of difference values each of which is a difference between two output values corresponding to each of the (n−1) pairs of sensors; and determining one specified position based on the (n−1) sets of difference values and correlation positions corresponding to the (n−1) sets of difference values and indicating positions correlated with array positions of each pair of sensors, wherein the electronic device is an electronic wind instrument having a mouthpiece on which the n number of sensors are arrayed, and wherein a contact position of a lip of an instrument player is determined based on the output values of the n number of sensors arrayed on the mouthpiece.

13. The detection method according to claim 12, wherein musical sound generation is controlled based on the determined one specified position.

14. The detection method according to claim 12, wherein the mouthpiece has a reed section on which the n number of sensors are arrayed from a first end side toward a second end side, the n number of sensors detecting a contact status of the lip, and wherein the contact position of the lip on the reed section in the direction from the first end side toward the second end side is determined based on the output values of the n number of sensors.

15. The detection method according to claim 14, wherein an operation position determined based on the correlation positions is a position of a change portion where the output values of the n number of sensors abruptly increase or decrease, and corresponds to an end serving as a boundary of the contact position of the lip having an area spreading in the direction from the first end side toward the second end side.

16. The detection method according to claim 15, wherein the contact position of the lip is corrected by a set offset value being added to or subtracted from the one specified position determined based on the correlation positions.

* * * * *